US010724244B2

(12) United States Patent
Nair

(10) Patent No.: US 10,724,244 B2
(45) Date of Patent: Jul. 28, 2020

(54) TILE ROOFING RISER

(71) Applicant: Leonard Vaughn Nair, Fallbrook, CA (US)

(72) Inventor: Leonard Vaughn Nair, Fallbrook, CA (US)

( * ) Notice: Subject to any disclaimer, the term of this patent is extended or adjusted under 35 U.S.C. 154(b) by 0 days.

(21) Appl. No.: 16/557,133

(22) Filed: Aug. 30, 2019

(65) Prior Publication Data

US 2020/0109564 A1 Apr. 9, 2020

Related U.S. Application Data

(60) Provisional application No. 62/741,696, filed on Oct. 5, 2018.

(51) Int. Cl.

| | |
|---|---|
| ***E04D 3/24*** | (2006.01) |
| *E04D 1/30* | (2006.01) |
| *E04D 13/04* | (2006.01) |

(52) U.S. Cl.

CPC ..... *E04D 3/24* (2013.01); *E04D 2001/308* (2013.01); *E04D 2013/0468* (2013.01)

(58) Field of Classification Search

CPC ..... E04D 3/24; E04D 2001/308; E04D 2013/0468

USPC ..... 52/518

See application file for complete search history.

(56) References Cited

U.S. PATENT DOCUMENTS

| | | | | |
|---|---|---|---|---|
| 3,608,261 | A * | 9/1971 | French | B28B 1/526 52/316 |
| 4,967,521 | A * | 11/1990 | Pike | E04D 12/00 52/58 |
| 6,233,887 | B1 * | 5/2001 | Smith | E04D 13/176 52/198 |
| 9,022,845 | B2 * | 5/2015 | Henderson | F24F 7/02 29/897.3 |
| 2004/0200170 | A1 * | 10/2004 | Fabel | E04D 1/34 52/506.01 |

* cited by examiner

*Primary Examiner* — Jeanette E Chapman
(74) *Attorney, Agent, or Firm* — Kilpatrick Townsend & Stockton LLP

(57) ABSTRACT

A roofing structure is disclosed. The roofing structure includes a roof sheathing structure, a riser positioned on the sheathing structure, and a felt positioned on the riser, where the riser is between the roof sheathing structure and the felt. The roofing structure also includes a first course of roof shingling elements placed on the felt and on the riser, where the riser causes a portion of a roof sheathing structure side of the first course of roof shingling elements and a portion of the felt to be spaced apart from the roof sheathing structure by at least about one quarter inch.

18 Claims, 9 Drawing Sheets

TILE ROOFING RISER

CROSS-REFERENCES TO RELATED APPLICATIONS

This application claims the benefit of U.S. Provisional application No. 62/741,696, filed Oct. 5, 2018, titled "STARTER STRIP FOR ROOFING SYSTEM," the disclosure of which is incorporated herein by reference.

FIELD OF THE INVENTION

The described embodiments relate generally to roofing systems for residential and commercial buildings. More particularly, the present embodiments relate to a plastic riser for tile roofs.

BACKGROUND OF THE INVENTION

Currently risers for tile roofing systems result in eventual water infiltration and the ultimate deterioration of the underlying roof structure.

BRIEF SUMMARY OF THE INVENTION

One inventive aspect is a roofing structure. The roofing structure includes a roof sheathing structure, a riser positioned on the sheathing structure, and a felt positioned on the riser, where the riser is between the roof sheathing structure and the felt. The roofing structure also includes a first course of roof shingling elements placed on the felt and on the riser, where the riser causes a portion of a roof sheathing structure side of the first course of roof shingling elements and a portion of the felt to be spaced apart from the roof sheathing structure by at least about one quarter inch.

In some embodiments, the portion of the felt spaced apart from the roof sheathing contacts riser and contacts the first course of roof shingling elements. In some embodiments, the felt completely overlaps the riser along a direction defined by a maximum slope of the roof sheathing structure. In some embodiments, the roofing structure further includes a second course of roof shingling elements placed on the felt and partially overlapping the first course of roof shingling elements, where the first course of roof shingling elements are positioned with substantially a first approximately consistent angle with respect to the roof sheathing structure, and where the second course of roof shingling elements are positioned with substantially a second approximately consistent angle with respect to the roof sheathing structure, where the first approximately consistent angle is substantially equal to the second approximately consistent angle. In some embodiments, the roofing structure further includes a second course of roof shingling elements placed on the felt and partially overlapping the first course of roof shingling elements, where a first line of maximum slope with respect to horizon along the first course of roof shingling elements is substantially parallel with a second line of maximum slope with respect to horizon along the second course of roof shingling elements. In some embodiments, the riser further includes a drip edge. In some embodiments, the riser further includes a plurality of ribs extending between the first course of roof shingling elements and the roof sheathing structure, where the ribs contact roof sheathing structure.

Another inventive aspect is a roofing riser, including a panel, substantially defining a first plane, and a plurality of ribs extending from the panel, where the distal ends of the ribs substantially define a second plane, where the first and second planes intersect at a line, where a distance from the line to an opposite edge of the panel is greater than about six inches, where the riser can support more than about 150 pounds, and where at least one of the ribs extends from the panel within one inch from the opposite edge.

In some embodiments the riser further includes a drip edge extending substantially from the opposite edge of the panel, where the drip edge extends through the second plane. In some embodiments the riser further includes a feature indicating a location for a nail or a staple to be driven through the riser so that the nail or staple does not hit any of the ribs.

Another inventive aspect is a method of building a roofing structure. The method includes placing a riser on a roof sheathing structure, and placing a felt on the riser, where the riser is between the roof sheathing structure and the felt. The method also includes placing a first course of roof shingling elements on the felt and on the riser, where the riser causes a portion of a roof sheathing structure side of the first course of roof shingling elements and a portion of the felt to be spaced apart from the roof sheathing structure by at least about one quarter inch.

In some embodiments, the method further includes driving a nail or a staple through the riser into the roof sheathing structure. In some embodiments, driving the nail or staple through the riser includes driving the nail or staple through an indication on or in the riser. In some embodiments, the method further includes sequentially placing a nail or a staple through each of 1) one of the first course of roof shingling elements, 2) the felt, and 3) the riser, where the nail or staple extends into the roof sheathing structure. In some embodiments, the portion of the felt spaced apart from the roof sheathing contacts riser and contacts the first course of roof shingling elements. In some embodiments, the felt completely overlaps the riser along a direction defined by a maximum slope of the roof sheathing structure. In some embodiments, the method further includes placing a second course of roof shingling elements on the felt, where the second course of shingling elements partially overlaps the first course of roof shingling elements, where the first course of roof shingling elements are positioned with substantially a first approximately consistent angle with respect to the roof sheathing structure, and where the second course of roof shingling elements are positioned with substantially a second approximately consistent angle with respect to the roof sheathing structure, where the first approximately consistent angle is substantially equal to the second approximately consistent angle. In some embodiments, the method further includes placing a second course of roof shingling elements on the felt, where the second course of shingling elements partially overlaps the first course of roof shingling elements, where a first line of maximum slope with respect to horizon along the first course of roof shingling elements is substantially parallel with a second line of maximum slope with respect to horizon along the second course of roof shingling elements. In some embodiments, the riser further includes a drip edge. In some embodiments, he riser further includes a plurality of ribs extending between the first course of roof shingling elements and the roof sheathing structure, where the ribs contact roof sheathing structure.

DETAILED DESCRIPTION OF THE INVENTION

Particular embodiments of the invention are illustrated herein in conjunction with the drawings.

Various details are set forth herein as they relate to certain embodiments. However, the invention can also be implemented in ways which are different from those described herein. Modifications can be made to the discussed embodiments by those skilled in the art without departing from the invention. Therefore, the invention is not limited to particular embodiments disclosed herein.

Some embodiments of this disclosure are directed to starter strips or risers for a roofing system, such as a tile roofing system, for a building. More specifically, when a roof is installed on a building the riser 10 is installed as a first row or course, and then the first course of roof shingling elements is installed over the riser 10. In some embodiments the riser 10 provides the first course of roofing with a proper angle (also known as rise) so the first course of roofing is aligned with and positioned at a similar angle as the second course and remaining courses of roofing. In some embodiments the riser 10 includes an integrated part of drip edge that protects the underlying roof structure from being contacted by water.

Figure 1:
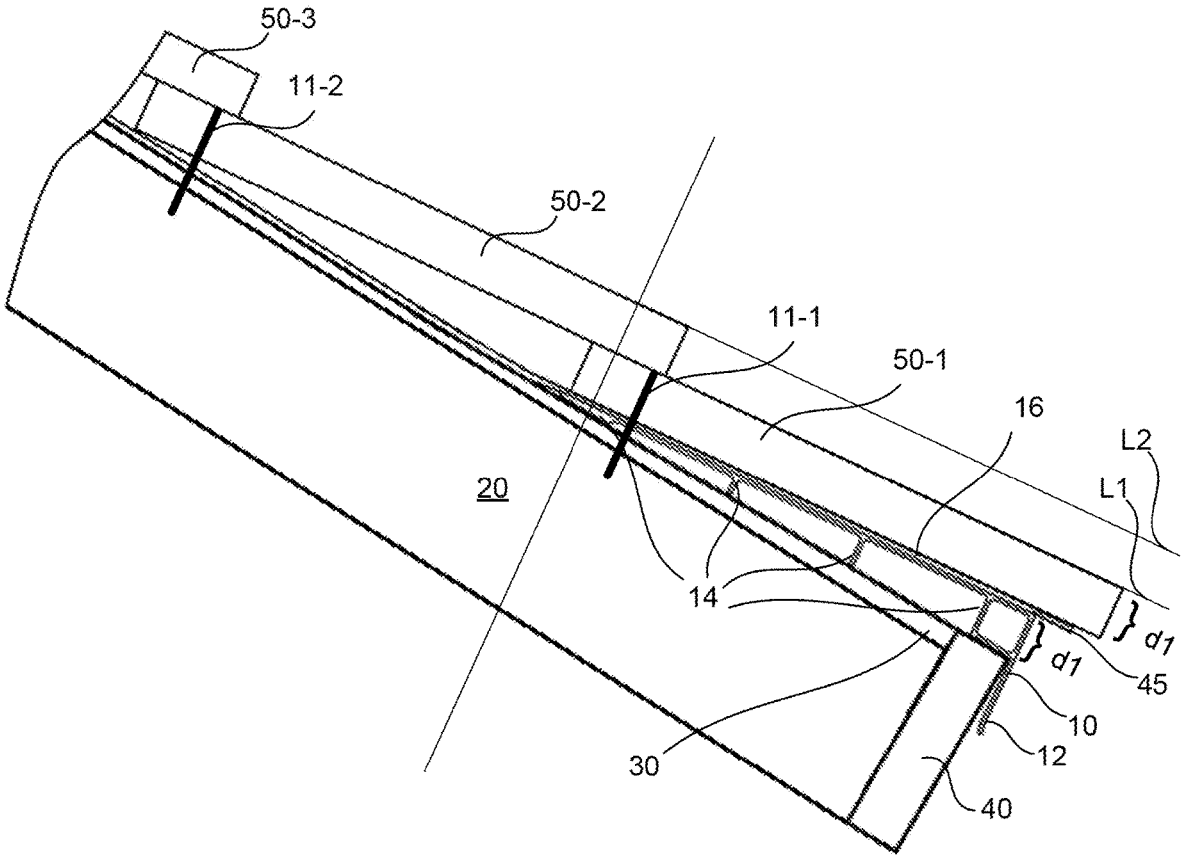
FIG. 1 illustrates a simplified cross-sectional view of an example riser installed on a roof.

FIG. 1 illustrates a simplified cross-sectional view of an example riser 10 installed on a roof. The roof structure can be made from wood, steel concrete or other material. In this case, the underlying roof structure includes a rafter 20, a sheathing structure 30, attached to the rafter 20, and fascia 40, also attached to the rafter 20. In this embodiment, rafter 20, sheathing structure 30, and fascia 40 are each wood.

Figure 2:
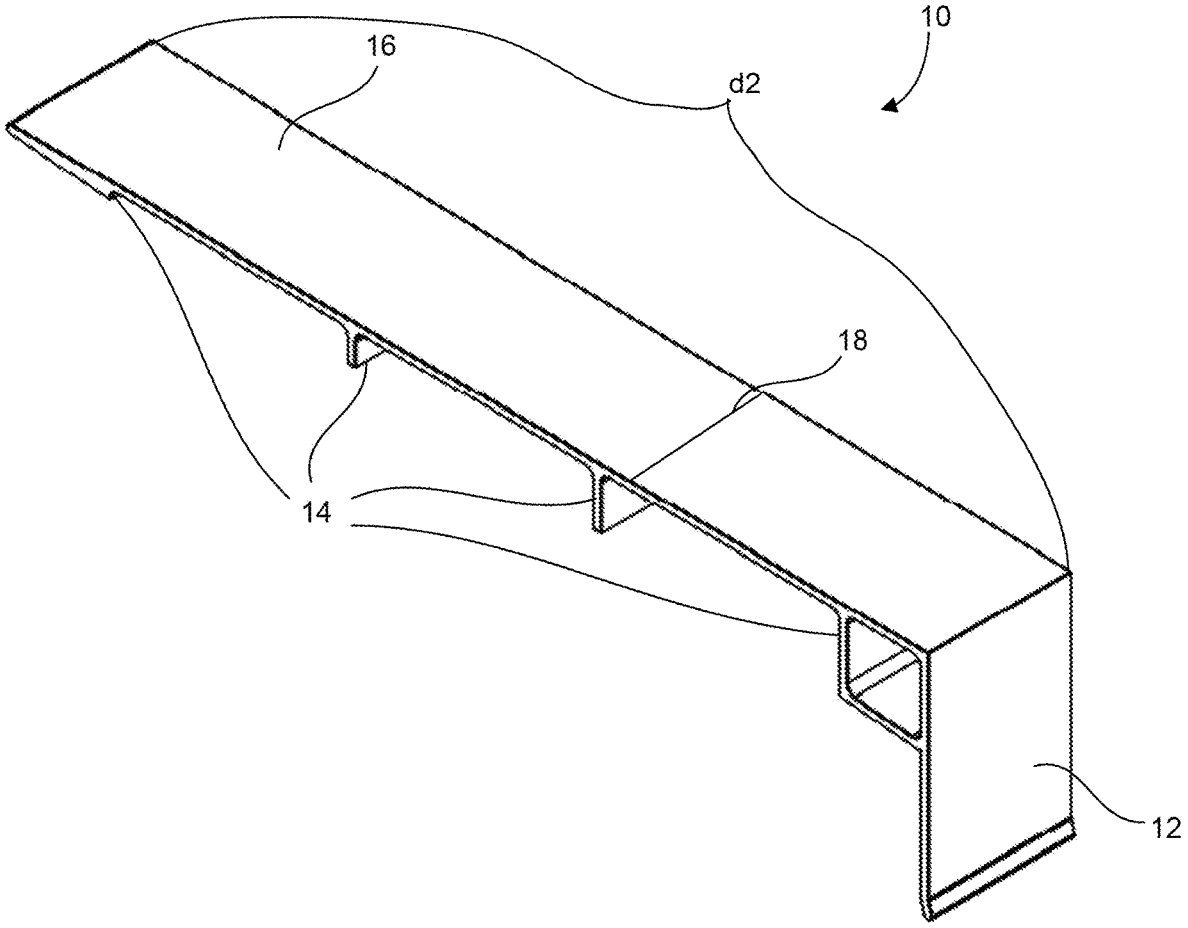
FIG. 2 illustrates an embodiment of a riser.

FIG. 2 illustrates an embodiment of the riser 10.

As shown in FIGS. 1 and 2, in some embodiments the riser 10 includes a substantially planar panel 16 including a substantially planar top surface and a plurality of ribs 14 extending from a bottom surface. The plurality of ribs 14 extend different lengths such that the ends of the ribs define a plane so that the panel in combination with the ribs 14 has a thickness of the panel at a leading edge and a relatively larger thickness at a trailing edge. In this embodiment, the trailing edge includes an optional drip edge 12, as described in more detail below. In some embodiments there is an equal spacing between the ribs 14, however other embodiments can have unequal spacing between the ribs 14.

In some embodiments the riser 10 is installed directly on top of the sheathing structure 30 and fascia 40.

Roofing paper 45, also known as felt, is then laid over the top surface of the sheathing structure 30 material and over top of a top surface of the riser 10. Next a first course of roof shingling elements 50-1 is placed on the felt 45 and on the riser 10. The roof shingling elements may be made of one or more of wood, slate, ceramic, flagstone, terracotta, metal, plastic, fiber, cement, and asphalt. The roof shingling elements may be generally rectangular and flat or may have substantial topology, such as curves. The roof shingling elements may be applied in courses, where each next course partially overlaps a preceding course.

In some embodiments the riser 10 is held in place by roof shingling elements 50-X. In some embodiments, the riser 10 is held in place by one or more nails or staples 11-1 extending through roof shingling elements 50-1, through riser 10, and into sheathing structure 30.

As shown in FIG. 1, the ribs 14 are positioned on the sheathing structure 30 and are arranged such that the top surface of the panel 16 is positioned at an angle with respect to the sheathing structure 30, providing a "rise" for the first course of roof shingling elements 50-1. In some embodiments, the rise for the first course of roof shingling elements 50-1 causes the first course of roof shingling elements 50-1 to be positioned at an angle with respect to sheathing structure 30 which is the same or substantially the same as the angle with respect to sheathing structure 30 that the second course of roof shingling elements 50-2 is positioned. In some embodiments, the rise for the first course of roof shingling elements 50-1 causes the first course of roof shingling elements 50-1 to be positioned at an angle with respect to sheathing structure 30 which is the same or substantially the same as the angle with respect to sheathing structure 30 that the third course of roof shingling elements 50-3 is positioned.

The embodiment illustrated in FIGS. 1 and 2 includes four ribs 14, however other embodiments may have fewer or more ribs 14. The last rib 14 closest to the trailing edge of the panel 16 can have a rectangular cross-sectional structure, called a spacer, that is hollow in the middle. The rectangular structure can provide not only a gap or rise between the panel 16 and the roof sheathing structure 30, but can also provide structure that enables the panel to resist moving under lateral loads. Other embodiments can have other dimensions to define the angle of the top surface of the panel 16 with respect to the top surface of the sheathing structure 30. For example, some alternative embodiments can have wedges, spacers made from a separate material or any other material to define the angle of the riser 10.

As further illustrated, the riser 10 can include an integrated drip edge 12 that protects the fascia 40 from water. The integrated drip edge 12 can extend into a rain gutter connected to fascia 40, as understood by those of skill in the art, to make a water shed system that conducts water from the roof into the rain gutter and prevents the roofing structure from being exposed to water and deteriorating, as understood by those of skill in the art. More specifically, as illustrated, the panel 16, and the drip edge 12 are integrally formed so there is no path for water to infiltrate the riser 10 and contact sheathing structure 30 or fascia 40 of the underlying roof structure. In some embodiments, the drip edge 12 is omitted.

A path for water to drain from the roof includes the upper surface of roof shingling elements 50-X. Water flows from course to course. Some of the draining water may fall from the first course of roof shingling elements 50-1 to the ground or into a rain gutter connected to fascia 40. Some of the draining water may flow along the underside of the first course of roof shingling elements 50-1 to felt 45.

Some modern may pass from the upper surface of roof shingling elements 50-X to the felt 45, which prevents such water from contacting the underlying roof structure. The water contacting the felt 45 is conducted to the edge of the felt 45, where it may fall from the felt 45 to the ground or into a rain gutter connected to fascia 40.

In some embodiments, water may exit felt 45 to drip edge 12, from which it may fall or flow to the ground or into a rain gutter connected to fascia 40.

In some embodiments, at least partly because of the "wedge shape," the riser 10 enables the roofing paper 45 to remain in place and not sag which could otherwise lead to water collection and rotting. Further, because of the wind shape, riser 10 provides the first course of roofing tiles 50-1 with support so they can support loads without breaking. In various embodiments the ribs 14 provide structural support to the riser 10 so it resists bending, thereby providing support to the first course of roofing tiles.

For example, in some embodiments, the first course of roof shingling elements 50-1 and riser 10, when arranged as illustrated in FIG. 1, can collectively support more than about 150 pounds, more than about 200 pounds, more than about 250 pounds, or more than about 300 pounds. Accordingly, riser 10 can support more than about 150 pounds, more than about 200 pounds, more than about 250 pounds, or more than about 300 pounds.

In various alternative embodiments, the riser 10 can be made without ribs 14 and can include a panel with an integrated drip edge. In such embodiments the first course of roof shingling elements may not need a spacer, and therefore the panel 16 can be arranged so as to be substantially parallel with the roof sheathing structure 30.

In some embodiments the riser 10 can comprise a plastic and in one embodiment is made from a UV-resistant PVC type plastic, but is in no way limited to this type of plastic. In other embodiments the riser 10 comprises another plastic, aluminum, another metal, concrete, wood, asphalt or any other type of material. In some embodiments a plastic riser 10 can be manufactured using extrusion, roto-molding, injection molding or other process. In some embodiments the riser 10 can be made from a metal sheet and the ribs 14 can be made from folded portions of the sheet metal. In various embodiments the riser 10 can be made in different colors by coloring the material it is made from or by painting the material it is made from.

In some embodiments one or more roofing nails or staples can hold the riser 10 in place. In other embodiments the riser 10 can be attached to the sheathing structure 30 with an adhesive such as, but not limited to, asphalt, roofing adhesive, caulk or other material.

In some embodiments multiple risers can be joined together with a coupler that covers a portion of each of two sequential risers. The coupler can be made from plastic or metal and join two risers together, providing a seam that is impervious to water penetration and that is aesthetically pleasing. In some embodiments a sealant or adhesive can be used with the coupler to improve its resistance to water penetration and to hold it in place. The coupler can include a pair of receiving openings positioned opposite and adjacent one another, one for each riser 10.

In some embodiments, adjacent risers are joined together with an adhesive.

In some embodiments, the distance d2 (See FIG. 2) of the riser 10 is about 6 inches, about 7 inches, about 8 inches, about 9 inches, about 10 inches, about 11 inches, about 12 inches, about 13 inches, about 14 inches, about 15 inches, about 16 inches, about 17 inches, about 18 inches, about 19 inches, about 20 inches, about 21 inches, about 22 inches, about 23 inches, or about 24 inches from the leading edge of panel 16 to the trailing edge of panel 16. In some embodiments, the spacer is between about 1 inch and about 1.5 inches. In some embodiments the drip edge is about 2 inches long. As understood by those of skill in the art, other embodiments may have different dimensions. In this embodiment the angle between the top surface of the riser 10 and the sheathing structure 30 is approximately 5 degrees, however other embodiments can have different angles depending on a thickness of the roof shingling elements. As understood by those of skill in the art, the distance d1 the spacer extends from sheathing structure 30 corresponds with a thickness of the roof shingling elements 50-X. As understood by those of skill in the art, the dimensions of the riser 10, including the distance the spacer extends from panel 16, the distance ribs 14 extend from panel 16, and the length of panel 16 cooperate to cause the first course of roof shingling elements 50-1 to be positioned at an angle with respect to sheathing structure 30 which is the same or substantially the same as the angle with respect to sheathing structure 30 that the second course of roof shingling elements 50-2 is positioned. In addition, as understood by those of skill in the art, the dimensions of the riser 10, including the distance the spacer extends from panel 16, the distance ribs 14 extend from panel 16, and the length of panel 16 cooperate to cause the first course of roof shingling elements 50-1 to be substantially parallel with the second course of roof shingling elements 50-2. In addition, as understood by those of skill in the art, the dimensions of the riser 10, including the distance the spacer extends from panel 16, the distance ribs 14 extend from panel 16, and the length of panel 16 cooperate to cause a first line L1 of maximum slope with respect to horizon along the first course of roof shingling elements 50-1 to be substantially parallel with a second line L2 of maximum slope with respect to horizon along the second course of roof shingling elements 50-2.

In some embodiments, roof shingling element portions, which are overlapped by other courses of roof shingling, are characterized by a thickness, and the various features of the riser 10 are dimensioned so as to cause a portion of a roof sheathing structure side of the first course of roof shingling elements 50-1 to be spaced apart from the roof sheathing structure by at least about one quarter the thickness of the roof shingling elements, by at least about one half the thickness of the roof shingling elements, by at least about three quarters the thickness of the roof shingle elements, by about the thickness of the roof shingling elements, or by about one and one quarter the thickness of the roof shingling elements.

In some embodiments, the various features of the riser 10 are dimensioned so as to cause a portion of a roof sheathing structure side of the first course of roof shingling elements 50-1 to be spaced apart from the roof sheathing structure by at least about one quarter inch, by at least about one half inch, by at least about three-quarter inch, by at least about one inch, by at least about one and one quarter inch, by at least about one and one half inch, by at least about one and three-quarter inches, or by about 2 inches.

In some embodiments the risers can be manufactured in lengths of 6, 8, 10 or 12 feet or in a continuous roll, however the invention is not limited to any of these lengths or configurations.

As shown in FIG. 2, riser 10 can include an indication 18, such as a line or an indentation indicating where a roofing staple or nail should be located to secure the riser 10 to the sheathing structure 30 material. In some embodiments, the location of the indication 18 corresponds with a gap between ribs 14, such that a staple or nail driven through riser 10 does not hit any of the ribs 14.

FIGS. 3A-3D illustrates certain phases of a method of applying a roof to a structure.

Figure 3A:
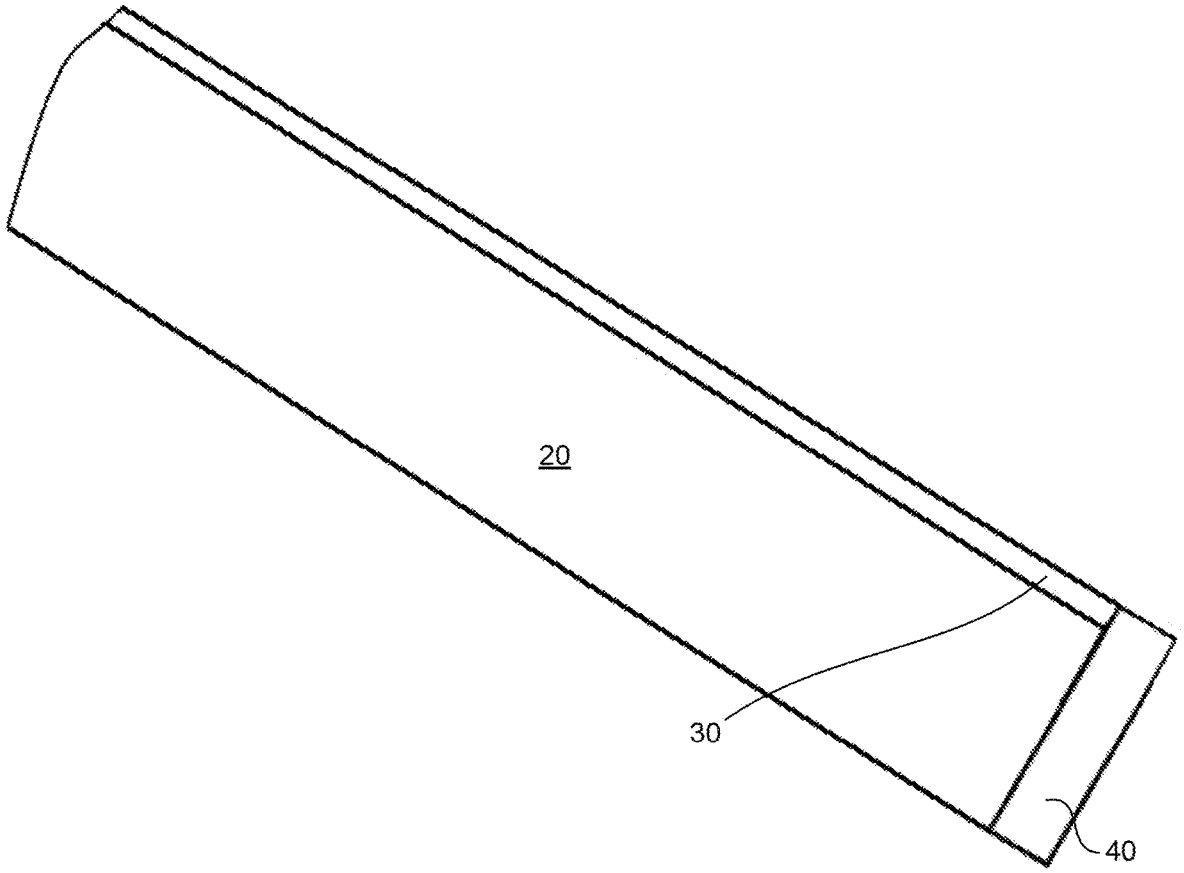
FIGS. 3A-3D illustrate certain phases of a method of applying a roof to a structure.

FIG. 3A illustrates a simplified cross-sectional view of an underlying roof structure. The underlying roof structure can be made from wood, steel concrete or other material. The illustrated underlying roof structure includes a rafter 20, sheathing structure 30, attached to the rafter 20, and fascia 40, also attached to the rafter 20. In this embodiment, rafter 20, sheathing structure 30, and fascia 40 are each wood.

Figure 3B:
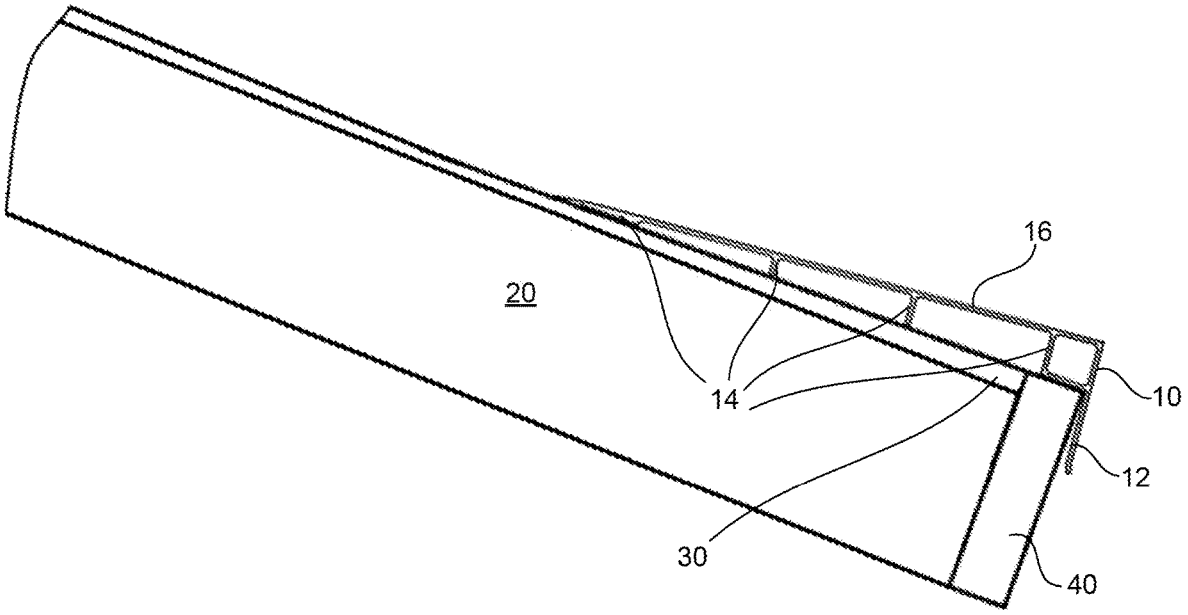

FIG. 3B illustrates riser 10 attached to the underlying roof structure. Riser 10 may, for example, be attached to one or both of sheathing structure 30 and fascia 40. For example, a nail or a staple may be used to attach riser 10 to sheathing structure 30. In some embodiments, a staple or nail may be driven through riser 10 into sheathing structure 30. The location of the staple or nail may be on or near an indication (not shown) formed in or on riser 10. In some embodiments, riser 10 may be additionally or alternatively attached to one or both of sheathing structure 30 and fascia 40 with an adhesive.

Figure 3C:
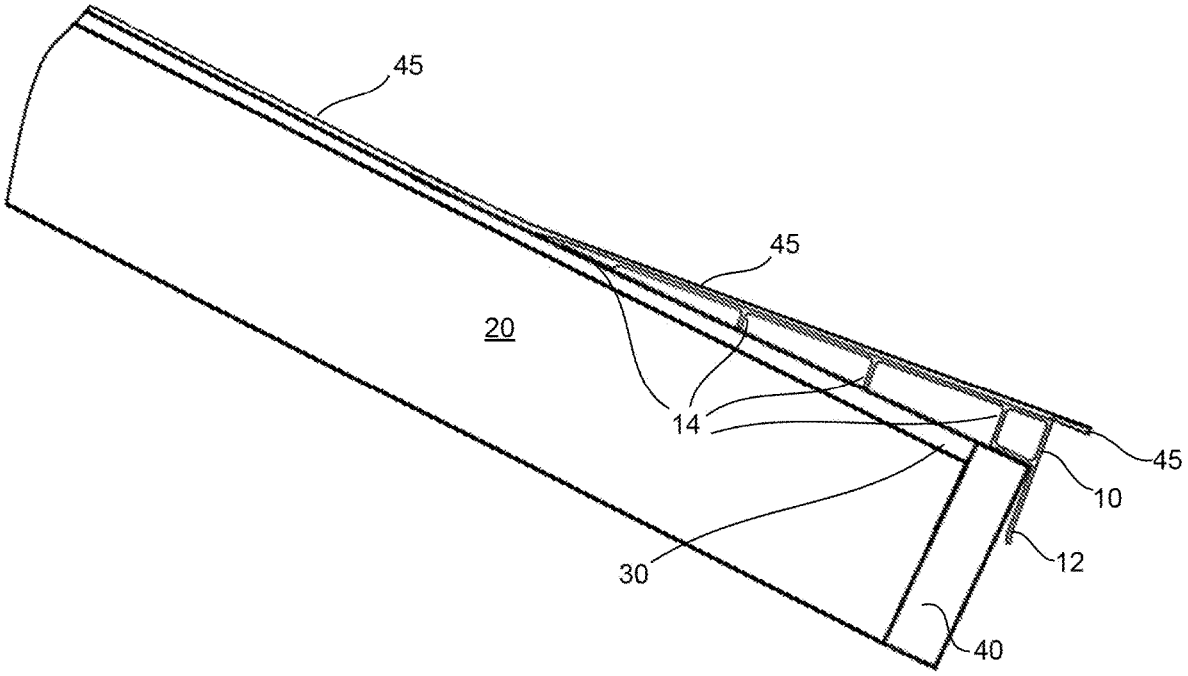

FIG. 3C illustrates felt 45 attached to riser 10 and sheathing structure 30. In some embodiments, felt 45 is placed on sheathing structure 30 and is attached thereto by gravity. In some embodiments, felt 45 is additionally or alternatively attached to sheathing structure 30 with one or more staples or nails. In some embodiments, felt 45 is additionally or alternatively attached to sheathing structure 30 with an adhesive. In some embodiments, felt 45 is placed on riser 10 and is attached thereto by gravity. In some embodiments, felt 45 is additionally or alternatively attached to riser 10 with one or more staples or nails. In some embodiments, felt 45 is additionally or alternatively attached to riser 10 with an adhesive.

Figure 3D:
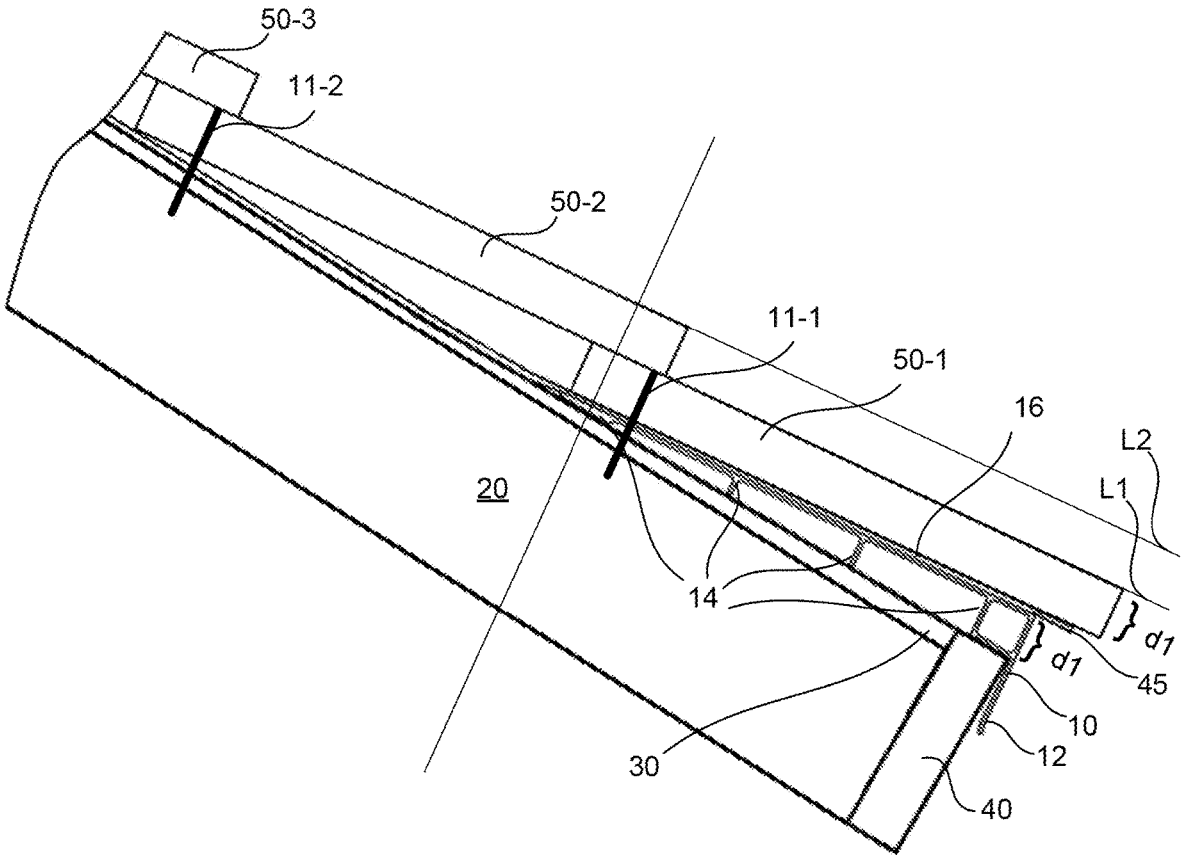

FIG. 3D illustrates roof shingling elements 50-X attached to the underlying roof structure.

The first course of roof shingling elements 50-1 is placed on a portion felt 45 which is on or attached to riser 10. A nail or staple may be driven through a hole in the first course of roof shingling elements 50-1. The nail or staple may be also driven through felt 45, through riser 10, and into sheathing structure 30.

The second course of roof shingling elements 50-2 is placed on a portion of the first course of roof shingling elements 50-1 and a portion felt 45 which is on or attached to sheathing structure 30. A nail or staple 11-2 may be driven through a hole in the second course of roof shingling elements 50-2. The nail or staple may be also driven through felt 45 and into sheathing structure 30.

As understood by those of skill in the art, the third course of roof shingling elements 50-3 is placed on a portion of the second course of roof shingling elements 50-2 and a portion felt 45 which is on or attached to sheathing structure 30. A nail or staple may be driven through a hole in the third course of roof shingling elements 50-3. The nail or staple may be also driven through felt 45 and into sheathing structure 30.

FIGS. 4A-4E illustrate various other embodiments of risers.

Figure 4A:
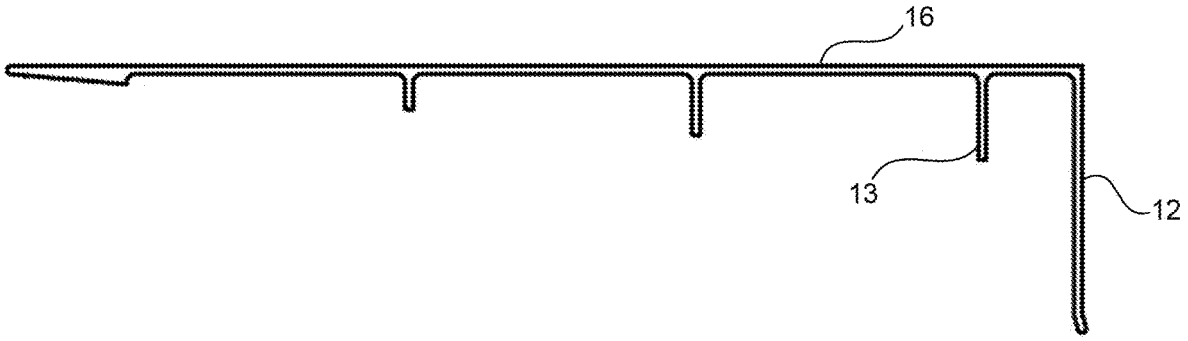
FIGS. 4A-4E illustrate various other embodiments of risers.

FIG. 4A illustrates a cross-section of a riser according to another embodiment. In the embodiment of FIG. 4A, the spacer is not enclosed. In addition, the spacer is effectively formed by a single rib 13, and the drip edge 12 extends from the panel 16.

Figure 4B:
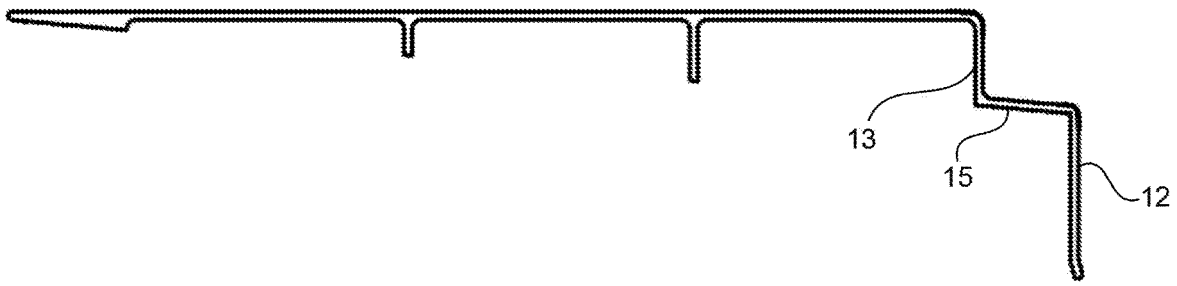

FIG. 4B illustrates a cross-section of a riser according to another embodiment. In the embodiment of FIG. 4B, the spacer is not enclosed. In addition, the spacer is effectively formed by a rib 13 connected to connector 15, and the drip edge 12 extends from rib 14.

Figure 4C:
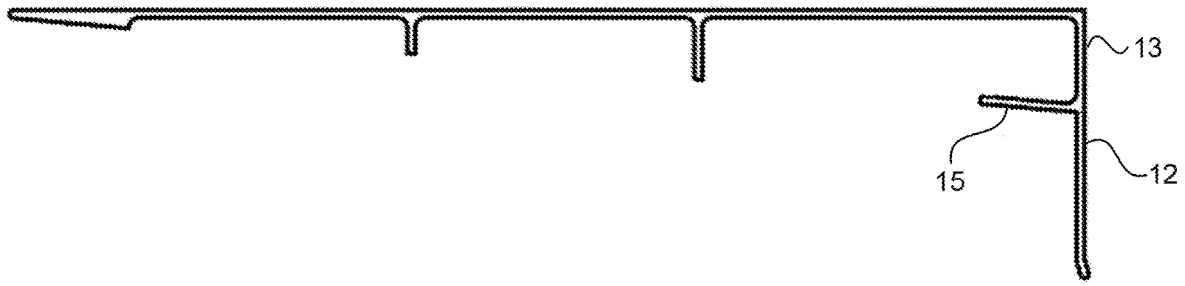

FIG. 4C illustrates a cross-section of a riser according to another embodiment. In the embodiment of FIG. 4C, the spacer is not enclosed. In addition, the spacer is effectively formed by a rib 13 and extension 15, and the drip edge 12 extends from rib 14.

Figure 4D:
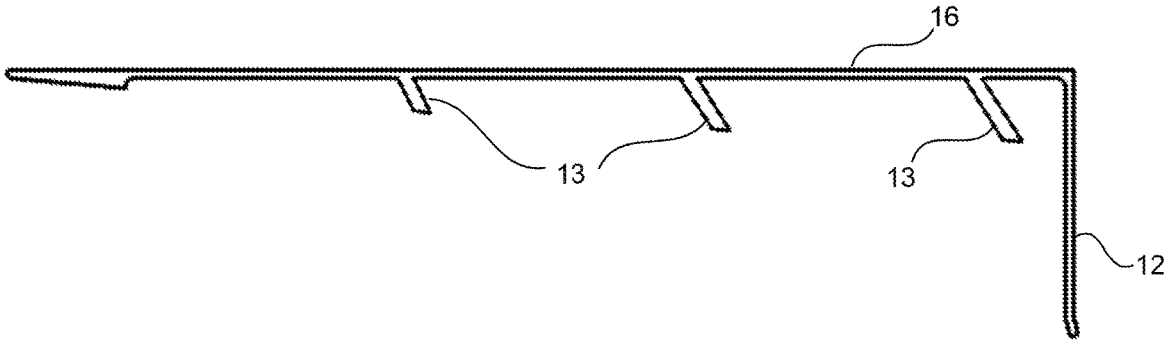

FIG. 4D illustrates a cross-section of a riser according to another embodiment. In the embodiment of FIG. 4D, the spacer is not enclosed. In addition, the spacer is effectively formed by a single rib 13, and the drip edge 12 extends from the panel 16. In addition, as shown, ribs 13 extend from panel 16 non-perpendicularly, and lean toward the drip edge and of the riser. The angles formed between the panel and ribs 13 may correspond with the size of the spacer, and the pitch of the sheathing structure 30 such that, when the riser is applied to the sheathing structure 30, the ribs 13 are substantially vertical.

Figure 4E:
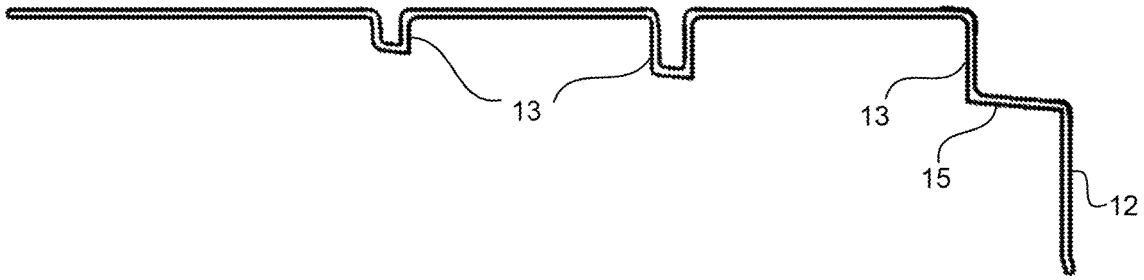

FIG. 4E illustrates a cross-section of a riser according to another embodiment. In the embodiment of FIG. 4E, the spacer is not enclosed. In addition, the spacer is effectively formed by a rib 13 connected to connector 15, and the drip edge 12 extends from rib 14. Furthermore, the riser of FIG. 4E is formed of a single piece of material having a substantially uniform thickness, and 2 of the ribs 13 are formed as continuations of the path defined by the substantially uniformly thick material. For example, in some embodiments, the riser of FIG. 4E is formed by bending a sheet of metal. In alternative embodiments, the riser of FIG. 4E is formed with an injection molding process, or an extrusion process.

Figure 5:
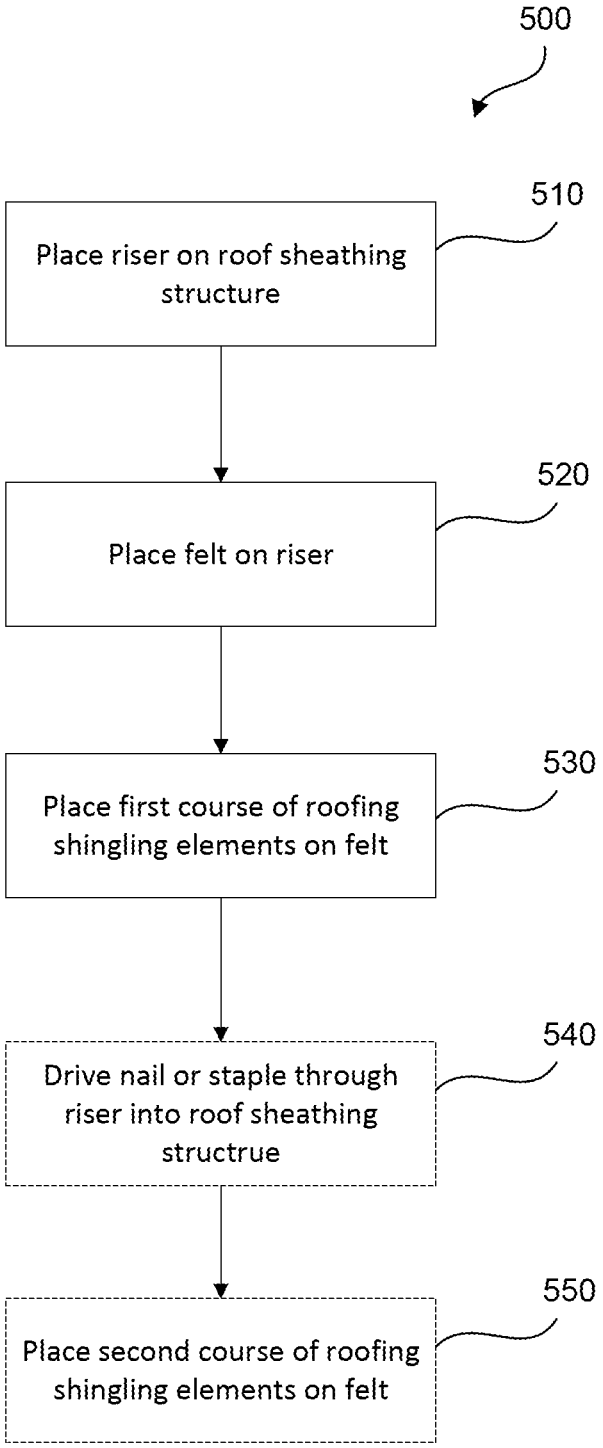
FIG. 5 illustrates a flowchart illustrating an embodiment of a method of building a roofing structure.

FIG. 5 illustrates a flowchart illustrating an embodiment of a method 500 of building a roofing structure.

At 510, a riser is placed on a roof sheathing structure.

At 520, a field is placed on the riser, such that the riser is between the roof sheathing structure and the felt.

At 530, a first course of roof shingling elements is placed on the felt and on the riser.

In some embodiments, the riser causes a portion of a roof sheathing structure side of the first course of roof shingling elements and a portion of the felt to be spaced apart from the roof sheathing structure by at least about one quarter inch.

In some embodiments, at 540, a nail or staple is driven through the riser into the roof sheathing structure. In some embodiments, the nail or staple is driven through an indication on or in the riser. In some embodiments, the nail or staple is sequentially placed through each of 1) one of the first course of roof shingling elements, 2) the felt, and 3) the riser, where the nail or staple extends into the roof sheathing structure.

In some embodiments, the portion of the felt spaced apart from the roof sheathing contacts the riser and contacts the first course of roof shingling elements In some embodiments, the felt completely overlaps the riser along a direction defined by a maximum slope of the roof sheathing structure.

In some embodiments, at 550, a second course of roof shingling elements is placed on the felt, where the second course of shingling elements partially overlaps the first course of roof shingling elements. The first course of roof shingling elements are positioned with substantially a first approximately consistent angle with respect to the roof sheathing structure, and the second course of roof shingling elements are positioned with substantially a second approximately consistent angle with respect to the roof sheathing structure, where the first approximately consistent angle is substantially equal to the second approximately consistent angle.

In some embodiments, at 550, a second course of roof shingling elements is placed on the felt, where the second course of shingling elements partially overlaps the first course of roof shingling elements. A first line of maximum slope with respect to horizon along the first course of roof shingling elements is substantially parallel with a second line of maximum slope with respect to horizon along the second course of roof shingling elements.

In some embodiments, the riser further comprises a drip edge.

In some embodiments, the riser further comprises a plurality of ribs extending between the first course of roof shingling elements and the roof sheathing structure, wherein the ribs contact roof sheathing structure.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

Though the present invention is disclosed by way of specific embodiments as described above, those embodiments are not intended to limit the present invention. Based on the methods and the technical aspects disclosed herein, variations and changes may be made to the presented embodiments by those of skill in the art without departing from the spirit and the scope of the present invention.

What is claimed is:

1. A roofing structure, comprising:

a roof sheathing structure;

a riser positioned on the roof sheathing structure;

a felt positioned on the riser, wherein the riser is between the roof sheathing structure and the felt;

a first course of roof shingling elements placed on the felt and on the riser;

a first fastener extending through a first roof shingling element of the first course of roof shingling elements, through the felt, through the riser, and into the roof sheathing structure, wherein the riser comprises a plurality of ribs extending between the first course of roof shingling elements and the roof sheathing structure, wherein the ribs contact the roof sheathing structure, and wherein the first fastener extends between a first and a second of the ribs;

a second course of roof shingling elements placed on the felt and on the first course of roof shingling elements; and a second fastener extending through a second roof shingling element of the second course of roof shingling elements, through the felt, and into the roof sheathing structure, without extending through the riser, wherein first and second courses of roof shingling elements are substantially rigid and have a thickness dimension in a particular direction substantially perpendicular from a first surface thereof facing the roof sheathing structure, wherein a line along the particular direction intersects the riser, a first particular roof shingling element of the first course, and a second particular roof shingling element of the second course, wherein lengths of the ribs are dimensioned such that the riser causes a portion of a roof sheathing structure side of the first course of roof shingling elements and a portion of the felt to be spaced apart from the roof sheathing structure by a distance substantially equal to the thickness dimension of the first course of roof shingling elements, such that a first line of maximum slope with respect to horizon along the first course of roof shingling elements is substantially parallel with a second line of maximum slope with respect to horizon along the second course of roof shingling elements, and wherein the first course of roof shingling elements cause a portion of a roof sheathing structure side of the second course of roof shingling elements to be spaced apart from the roof sheathing structure by a distance substantially equal to the thickness demension of the first course of roof shingling elements.

2. The roofing structure of claim 1, wherein the portion of the felt spaced apart from the roof sheathing structure contacts riser and contacts the first course of roof shingling elements.

3. The roofing structure of claim 1, wherein the felt completely overlaps the riser along a direction defined by a maximum slope of the roof sheathing structure.

4. The roofing structure of claim 1, wherein the first course of roof shingling elements are positioned with substantially a first approximately consistent angle with respect to the roof sheathing structure, wherein the second course of roof shingling elements are positioned with substantially a second approximately consistent angle with respect to the roof sheathing structure, and wherein the first approximately consistent angle is substantially equal to the second approximately consistent angle.

5. The roofing structure of claim 1, wherein the riser further comprises a drip edge.

6. The roof structure of claim 1, wherein the riser further comprises a feature indicating a location for the first fastener to extend through the riser.

7. A roofing shingling element on a roofing riser, the roofing riser comprising:

a panel, substantially defining a first plane; and a plurality of ribs extending from the panel, wherein distal ends of the ribs substantially define a second plane, wherein the first and second planes intersect at a line, wherein the longest of the ribs has a length substantially equal to a thickness of the roof shingling element, wherein a distance from the line to an opposite edge of the panel is substantially equal to a length of the roof shingling element, wherein the roofing riser can support more than about 150 pounds, and wherein the longest of the ribs extends from the panel within one inch of the opposite edge.

8. The roof shingling element and roofing riser of claim 7, further comprising a drip edge extending substantially from the opposite edge of the panel, wherein the drip edge extends through the second plane.

9. The roof shingling element and roofing riser of claim 7, further comprising a feature indicating a location for a nail or a staple to be driven through the roofing riser so that the nail or staple does not hit any of the ribs.

10. A method of building a roofing structure, the method comprising:

placing a riser on a roof sheathing structure;

placing a felt on the riser, wherein the riser is between the roof sheathing structure and the felt;

placing a first course of roof shingling elements placed on the felt and on the riser;

driving a first fastener through a first roof shingling element of the first course of roof shingling elements, through the felt, through the riser, and into the roof sheathing structure, wherein the riser comprises a plurality of ribs extending between the first course of roof shingling elements and the roof sheathing structure, wherein the ribs contact the roof sheathing structure, and wherein the first fastener extends between a first and a second of the ribs;

placing a second course of roof shingling elements on the felt and on the first course of roof shingling elements; and driving a second fastener extending through a second roof shingling element of the second course of roof shingling elements, through the felt, and into the roof sheathing structure, without extending through the riser, wherein the first and second courses of roof shingling elements are substantially rigid and have a thickness dimension in a particular direction substantially perpendicular from a first surface thereof facing the roof sheathing structure, wherein a line along the particular direction intersects the riser, a first particular roof shingling element of the first course, and a second particular roof shingling element of the second course, wherein lengths of the ribs are dimensioned such that the riser causes a portion of a roof sheathing structure side of the first course of roof shingling elements and a portion of the felt to be spaced apart from the roof sheathing structure by a distance substantially equal to the thickness dimension of the first course of roof shingling elements, such that a first line of maximum slope with respect to horizon along the first course of roof shingling elements is substantially parallel with a second line of maximum slope with respect to horizon along the second course of roof shingling elements, and wherein the first course of roof shingling elements cause a portion of a roof sheathing structure side of the second course of roof shingling elements to be spaced apart from the roof sheathing structure by a distance substantially equal to the thickness dimension of the first course of roof shingling elements.

11. The method of claim 10, wherein driving the first fastener through the riser comprises driving the first fastener nail or staple through an indication on or in the riser.

12. The method of claim 10, wherein the portion of the felt spaced apart from the roof sheathing structure contacts riser and contacts the first course of roof shingling elements.

13. The method of claim 10, wherein the felt completely overlaps the riser along a direction defined by a maximum slope of the roof sheathing structure.

14. The method of claim 10, wherein the first course of roof shingling elements are positioned with substantially a first approximately consistent angle with respect to the roof sheathing structure, wherein the second course of roof shingling elements are positioned with substantially a second approximately consistent angle with respect to the roof sheathing structure, and wherein the first approximately consistent angle is substantially equal to the second approximately consistent angle.

15. The method of claim 10, wherein the riser further comprises a drip edge.

16. The roofing structure of claim 1, wherein the ribs of the riser extend toward the roof sheathing structure in a direction which is substantially vertical, and which is not perpendicular with respect to the roof sheathing structure.

17. The roofing shingling element and roofing riser of claim 7, wherein the ribs of the roofing riser extend from the panel in a direction which is not perpendicular to the panel.

18. The method of claim 10, wherein the ribs of the riser extend toward the roof sheathing structure in a direction which is substantially vertical, and which is not perpendicular with respect to the roof sheathing structure.

* * * * *